US011624259B2

(12) United States Patent
Rao

(10) Patent No.: US 11,624,259 B2
(45) Date of Patent: Apr. 11, 2023

(54) SECURE SHUTDOWN SYSTEM FOR WELLHEADS

(71) Applicant: WORLDWIDE OILFIELD MACHINE, INC., Houston, TX (US)

(72) Inventor: Ramesh Rao, Missouri City, TX (US)

( * ) Notice: Subject to any disclaimer, the term of this patent is extended or adjusted under 35 U.S.C. 154(b) by 59 days.

(21) Appl. No.: 17/341,786

(22) Filed: Jun. 8, 2021

(65) Prior Publication Data

US 2021/0381342 A1 Dec. 9, 2021

Related U.S. Application Data

(60) Provisional application No. 63/036,643, filed on Jun. 9, 2020.

(51) Int. Cl.

| | |
|---|---|
| ***E21B 34/02*** | (2006.01) |
| ***E21B 34/10*** | (2006.01) |
| ***E21B 34/16*** | (2006.01) |

(52) U.S. Cl.

CPC ..... *E21B 34/16* (2013.01); *E21B 34/02* (2013.01); *E21B 34/10* (2013.01)

(58) Field of Classification Search

CPC ..... E21B 21/08; E21B 34/02; E21B 34/10; E21B 34/16; E21B 44/00

See application file for complete search history.

(56) References Cited

U.S. PATENT DOCUMENTS

| | | | | |
|---|---|---|---|---|
| 3,906,726 | A * | 9/1975 | Jameson | E21B 21/08 137/236.1 |
| 5,132,904 | A | 7/1992 | Lamp | |
| 6,116,268 | A | 9/2000 | Johnson | |
| 6,199,629 | B1 | 3/2001 | Shirk | |
| 6,289,434 | B1 | 9/2001 | Roy | |
| 9,441,453 | B2 | 9/2016 | Lymberopoulos | |
| 9,890,609 | B2 | 2/2018 | Lymberopoulos | |
| 2010/0300702 | A1 | 12/2010 | Andrews | |
| 2018/0245452 | A1 * | 8/2018 | Mujica | E21B 41/0021 |
| 2021/0381342 | A1 * | 12/2021 | Rao | E21B 34/16 |

FOREIGN PATENT DOCUMENTS

| | | | | |
|---|---|---|---|---|
| CN | 104791526 | A * | 7/2015 | E21B 34/02 |
| CN | 110185407 | A * | 8/2019 | |
| CN | 213176993 | U * | 5/2021 | |
| CN | 214247830 | U * | 9/2021 | |
| CN | 216197995 | U * | 4/2022 | |

* cited by examiner

*Primary Examiner* — Daniel P Stephenson
(74) *Attorney, Agent, or Firm* — Kenneth L. Nash

(57) ABSTRACT

The present invention discloses a secure shutdown system to control a surface valve and a subsurface valve that are mounted to a wellbore. A housing is provided in which is mounted a manual hydraulic pump, a reset panel control switch, and a hydraulic switch controlled by a programmable logic controller. The reset switch is normally operable to move the hydraulic switch to a position to allow the manual hydraulic pump to open the subsurface valve. The programmable logic controller being configured to be responsive to a security shutdown signal to prevent operation of the reset panel control switch. The programmable logic controller is programmed to normally operate with less than ten microamperes.

10 Claims, 4 Drawing Sheets

SECURE SHUTDOWN SYSTEM FOR WELLHEADS

FIELD OF THE INVENTION

The present invention relates to a method of monitoring the operation of a remote wellhead. More particularly the invention relates to a system and method for securely closing and/or controlling fluid flow and shutdown of a local and/or remote wellhead.

BACKGROUND OF THE INVENTION

The present invention relates to a shutdown control system for closing the SSV (Surface Safety Valve) and SCSSV (Subsurface Controlled Safety Valve) especially in response to the operation of the abnormal operation of the wellhead.

Well Head Control Panels (WHCPs) are also known as Emergency Shutdown Panels, Emergency Shutdown Systems (ESD) or Hydraulic Safety Shutdown System (HSSS). These are failsafe shutdown systems. WHCPs are standalone control systems as well as an interface between the plant control and the wellhead safety system. WHCPs are used for monitoring, controlling (Remote/Local) and safe shutdown of Subsurface Controlled Safety Valves (SCSSV), Surface Safety Valves (SSV).

WHCPs may be used to shut down the well if there is a blockage in the pipeline, if the local tank becomes full, or if other problems arise.

One problem with prior art WHCPs is the lack of security features. WHCPs are typically operated locally (near the wellhead). This allows thieves, e.g. terrorists or other groups, who wish to capture and operate the wells ready access to the oil. They can close the SSV to make their own connections to the flowline and then open the SSV to supply oil to their own tankers. The oil can then be sold in the black market and used as terror funds. The lack of security features also allows destroying the wellhead and setting fire to the oil that then uncontrollably comes to the surface when the wellhead is recaptured.

Another problem with prior art WHCPs is the power requirement for operation. Wells are often remotely located where there is no readily available electrical power. For example, wells in arctic regions may be well outside of the access of power lines and may not even see sunlight for months at a time.

Those of skill in the art will appreciate the present invention that provides solutions to these and/or other problems.

SUMMARY OF THE INVENTION

An objective of the present invention is to provide safety shutdown control for a SSV (Surface Safety Valve) and SCSSV (Subsurface Controlled Safety Valve).

Another objective of the present invention is to provide a security system that can prevent unauthorized access to oil/gas in the well even if the well is captured or controlled by thieves.

Yet another objective of the SSD of the present invention is to provide a control panel for monitoring/controlling pilot pressure, SSV pressure, and SCSSV pressure with a battery system that reliably operates for years so that external power is unnecessary.

Yet another objective of the SSD of the present invention is to provide a small electro-hydraulic unit that can be easily transported and mounted to remotely located wellheads to provide security without the need for external electrical power.

Yet another objective of the SSD of the present invention is to provide a self-contained unit that requires very little maintenance with the hydraulics and battery being strategically located within a weatherproof cabinet.

Yet another objective of the SSD of the present invention is an electronic system designed to operate on a micro-current basis that provides 3-5 years life with a small lithium battery supply.

Yet another objective of the SSD of the present invention is to provide an SSD that interfaces to RTU/SCADA providing all necessary information such as system status, battery status, hydraulic pressure of the SSV (pressure transmitter/switch) and does not need any additional hardware for interface and may also provide an additional relay contact to add any desired additional control.

Yet another objective is to provide hydraulic circuits with pressure compensating accumulators that compensate the pressure loss due to temperature.

Yet another objective is to provide that the SSD of the present invention can be remotely shutdown from an RTU/SCADA unite and can be disabled from a remote location. In one embodiment, the SSD disables a reset of the SSD so that when the SCSSV is closed, it can no longer be opened by thieves so that the well is secured from unauthorized operation.

The present invention provides a shutdown control system for closing the SSV and SCSSV in response to the operation of the abnormal operation of the wellhead. The SSD system is a self-contained battery operated unit which uses an Electronic logic unit which monitors the conditions of the wellbore and rapidly communicates with a Solenoid valve to close the SSV and SCSSV.

Yet another objective is to provide an SSD that requires no personnel to monitor the well locally that can be shut down completely and disable from further usage by remote operation.

An advantage of the present invention is that of saving lives by avoiding the need for local personnel and because once the downhole SCSSV is closed there is no access to the well. Utilizing this SSD saves the world from terrorist organizations gaining significant and easy monetary funds through black market oil supply.

Another advantage of the long life battery operated SSD system is that power to an electronic system can be a big problem due to remote operation where accessibility is difficult. This is a major advantage in keeping the operating cost of the SSD low by avoiding the need for frequent visits to the site to replace the battery.

SUMMARY OF THE INVENTION

The Secure Shutdown system of the present invention may preferably comprise (1) a pressure release valve and (2) a 2-position electronically controlled solenoid valve. The (3) electronic logic unit drives the 2-position solenoid valve to open position to release the pressure from the pressure releasing valve to release the actuator pressure on the SSV and SCSSV so that the valves can close. The SSD system includes (4) a manual hydraulic pump and a hydraulic reservoir, (5) small accumulators are included in the pressure lines to compensate pressure so that pressure variance due to temperature and the like does not affect the operation of the SSV and SCSSV, (6) A Switching pressure gauge for line pressure monitoring and an isolator for isolating the well boar fluids.

The SSD system is a self-contained battery operated unit which uses an Electronic logic unit which monitors the conditions of the wellbore and rapidly communicates with a Solenoid valve to close the SSV and SCSSV.

The present invention can also be integrated with PLC (Programmable Logic Control)/RTU (Remote Control Terminal)/SCADA (Supervisory Control Application and Data Acquisition).

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

One general aspect includes a secure shutdown system is connectable with a surface valve and a subsurface valve that are mounted to a wellbore. The secure shutdown system also includes a system housing; a first manual hydraulic pump, the first manual hydraulic pump being hydraulically connectable to the subsurface valve to open the subsurface valve. The system also includes a hydraulic switch mounted to the system housing, the hydraulic switch being moveable between a first position and a second position, in the first position the hydraulic switch being configured to allow hydraulic fluid pressure from the first manual hydraulic pump to communicate with the subsurface valve to open the subsurface valve, in the second position the hydraulic switch being configured to prevent the first manual hydraulic pump from opening the subsurface valve. The system also includes a panel control switch mounted to the system housing; and a logic controller mounted in the system housing, the logic controller electrically connecting to the hydraulic switch and to the panel control switch, the logic controller being programmed to respond to the panel control switch to move the hydraulic switch to the first position, the logic controller being programmed to be responsive to a security shutdown signal to move the hydraulic switch to the second position whereupon the panel control switch is no longer operable to move the hydraulic switch to the first position. Other embodiments of this aspect include corresponding computer systems, apparatus, and computer programs recorded on one or more computer storage devices, each configured to perform the actions of the methods.

Implementations may include one or more of the following features. The system may include the first manual hydraulic pump being mounted to the system housing. The system may include a second manual hydraulic pump being hydraulically connectable to the surface valve to open the surface valve, the second manual hydraulic pump being mounted to the system housing, when the hydraulic switch is in the first position then the hydraulic switch is configured to allow hydraulic fluid pressure from the second manual hydraulic pump to communicate with the surface valve to open the surface valve, in the second position the hydraulic switch being configured to prevent hydraulic fluid pressure from the second manual hydraulic pump from opening the surface valve. The system may include the logic controller may include a programmable logic chip that is programmed so that an average current draw for the programmable logic chip is less than ten microamperes. The programmable logic chip is programmed to substantially limit operation to scanning inputs to check for a presence of an input requiring processing so long as an input requiring processing is not present. The programmable logic chip is programmed to limit outputs to a pulse less than ten milliseconds in duration. The system further a control to monitor battery power, the control producing a well shutdown signal when battery power drops below a predetermined level. The security shutdown signal is received from a telemetry system connector. The security shutdown signal is produced by manually removing a component from the system housing. The system may include a plurality of accumulators to compensate pressure in a plurality of pressure lines so that a pressure variance due to temperature is reduced.

Implementations of the described techniques may include hardware, a method or process, or computer software on a computer-accessible medium.

These and other objectives, features, and advantages of the present invention will become apparent from the drawings, the descriptions given herein, and the appended claims. However, it will be understood that above-listed objectives and/or advantages of the invention are intended only as an aid in understanding aspects of the invention, are not intended to limit the invention in any way, and therefore do not form a comprehensive or restrictive list of objectives, and/or features, and/or advantages.

BRIEF DESCRIPTION OF THE DRAWINGS

The following detailed description and claims are merely illustrative of the generic invention. Additional modes, advantages, and particulars of this invention will be readily suggested to those skilled in the art without departing from the spirit and scope of the invention. A more complete understanding of the invention and many of the attendant advantages thereto will be readily appreciated by reference to the following detailed description when considered in conjunction with the accompanying drawings, wherein like reference numerals refer to like parts and wherein:

DETAILED DESCRIPTION

Detailed descriptions of the invention are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
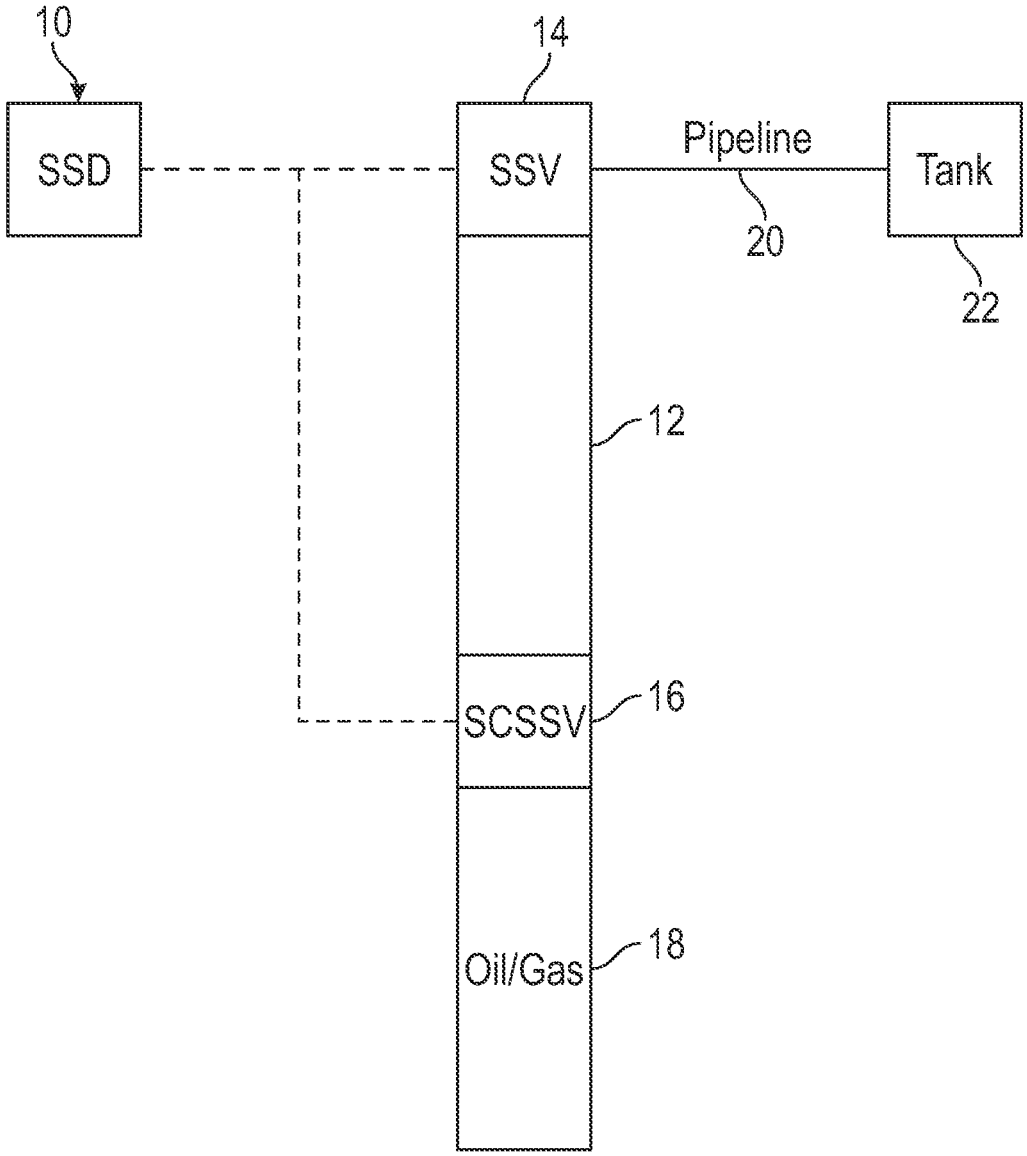
FIG. 1 is a schematic that shows an SSD to control the SSV and SCSSV for a well in accord with one embodiment of the present invention.

Referring now to the drawings, and more particularly to FIG. 1, there is shown (Secure Shutdown System) SSD 10 that utilizes (Surface Safety Valve) SSV 14 and (Subsurface Controlled Safety Valve) SCSSV 16 to control wellbore 12 that intersects with oil/gas reservoir 18. When the SSV or surface valve 14 and SCSSV or subsurface valve 16 are open, then oil/gas, e.g. hydrocarbon fluid flow may flow through out of wellbore 12 through a fluid flow path through the valves and into pipeline 20 and/or tank 22. The SSV 14 and SCSSV 16 valves may typically be failsafe valves whereby hydraulic pressure applied to the valves will open the valves but once hydraulic pressure is lost then the valves return to a failsafe position or in this case a closed position. When the SCSSV 16 is closed to prevent fluid flow, then access to the oil/gas 18 is prevented even if the SSV 14 is removed, damaged, or destroyed.

In the present invention SSD 10 may be used to shut subsurface valve 16 in a manner that is very difficult for thieves to open by releasing pressure to the valve so that it defaults to the failsafe or closed position. In the case a security shutdown signal that may be produced locally or remotely, SSD 10 prevents pressure from a hydraulic pump built into the SSD 10 that is normally used to open SCSSV 16 from connecting to it. Then even if the surface valve is destroyed, the well remains shut in with the oil safe from thieves. The SSD 10 will also be able to shut the well in when various shutdown signals such as fault conditions are detected such as a high pipeline pressure that indicates a blockage, or a low pipeline pressure that indicates a leak, or the tank being full, or other shutdown signals such as a signal to close the valve from an operator. Thus, various shutdown signals may be utilized to close in the well that may be sent locally or by telemetry. While the operation of the well may be restored with a reset control signal, once a security shutdown signal is received by the logic control board then the reset control on the SSD 10 no longer operates to allow the surface and subsurface valves to be opened.

Figure 2:
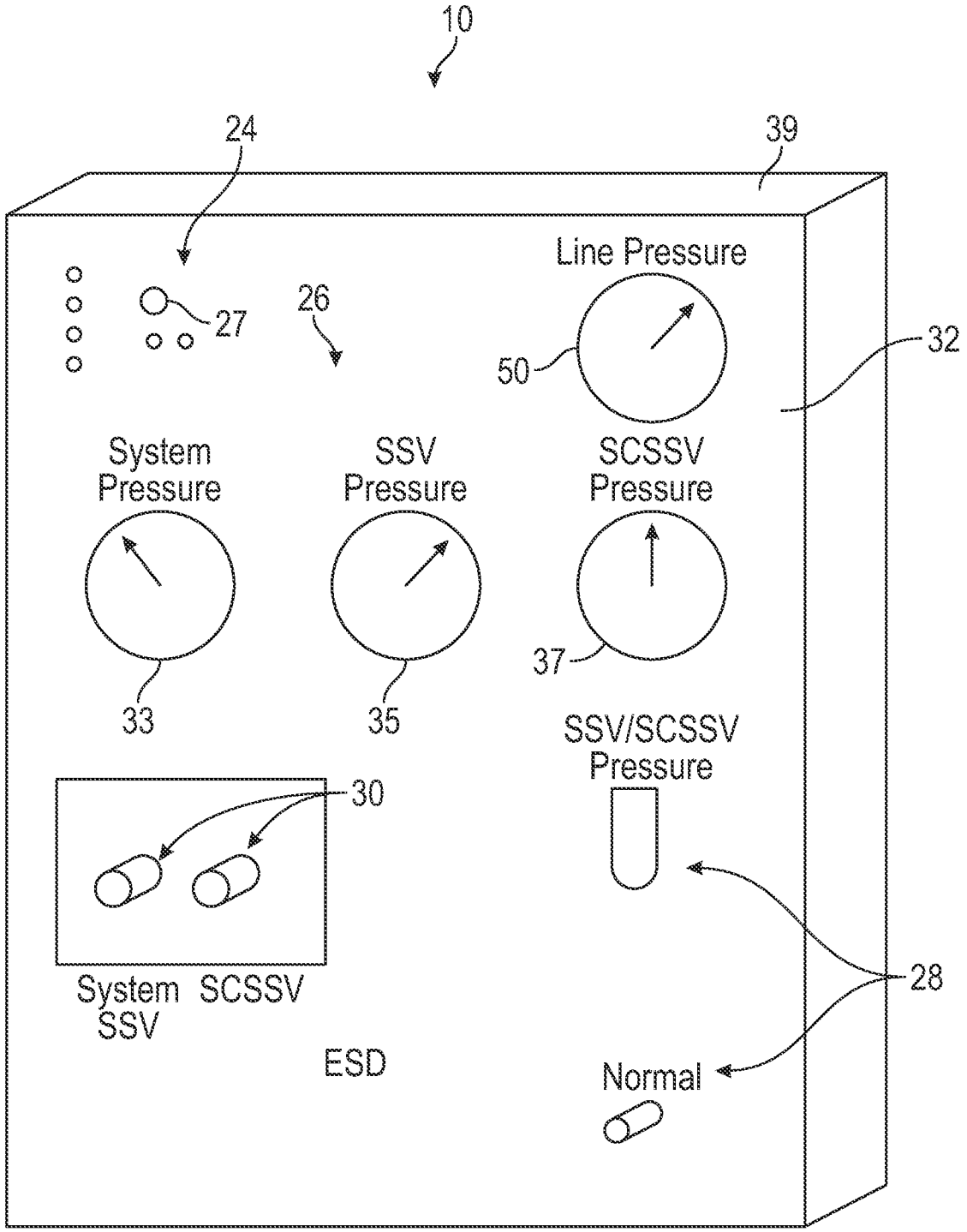
FIG. 2 shows an embodiment of a panel for the SSD with controls, indicators, gauges, manual operation in accord with one embodiment of the present invention.
Figure 4:
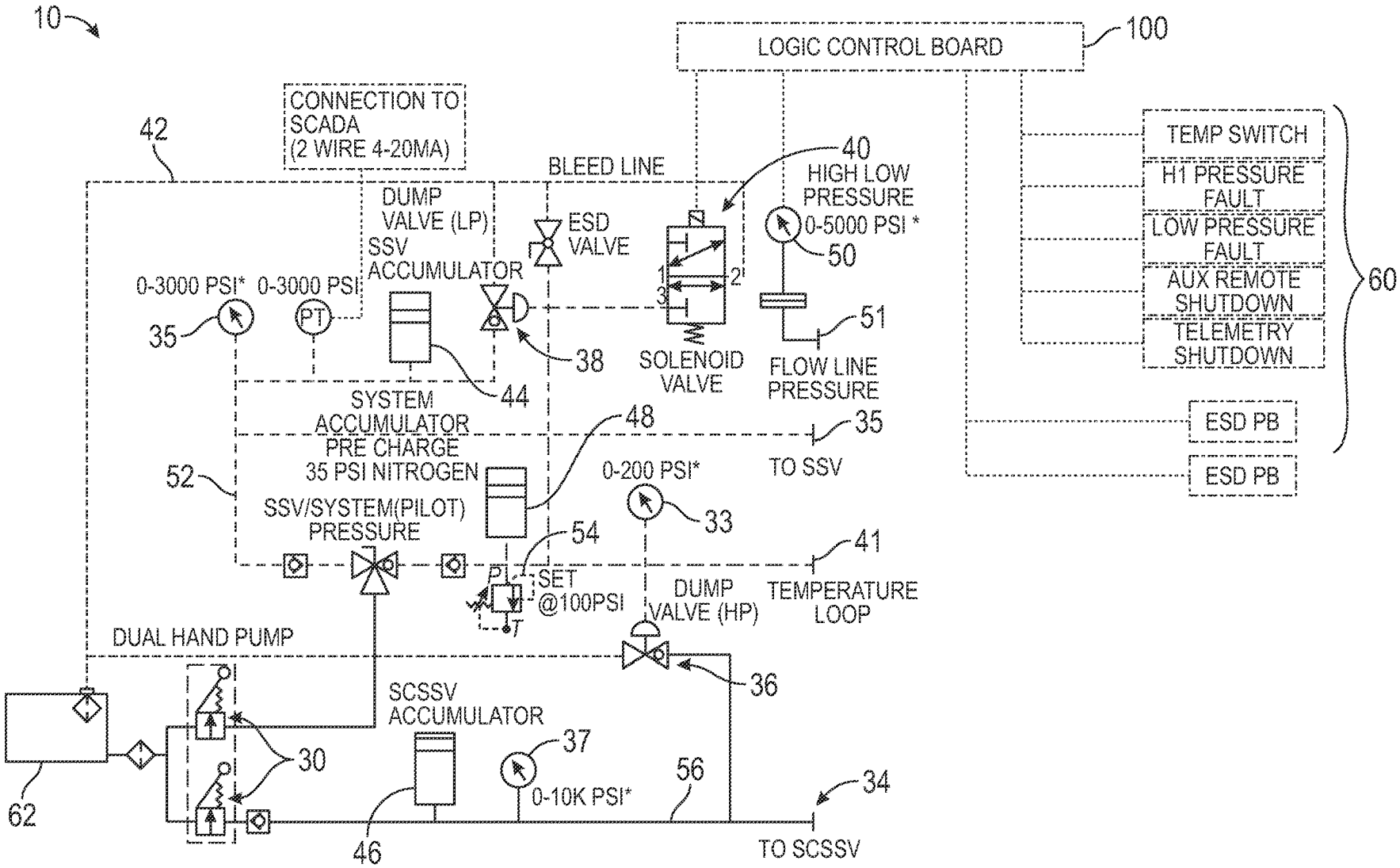
FIG. 4 is a schematic showing hydraulics used in the SSD with connections to the logic control unit in accord with one embodiment of the present invention.

FIG. 2 shows a possible front panel 32 configuration for SSD 10. A weather proof cabinet or housing 39 for front panel 32 contains electronics and hydraulics for SSD 10 as schematically shown in FIG. 4.

Items 24 are LED indicator lights on front panel 32 that include at least one reset switch 27. Reset switch 27 is a panel control that when used during normal operation provides a signal to a programmable logic chip 102 (from FIG. 3) that moves a solenoid or hydraulic switch 40 (from FIG. 4) to allow hydraulic fluid pressure from manual pumps 30 to open the SSV 14 and SCSSV 16.

Items 26 are various pressure gauges such as a system pressure or pilot pressure gauge 33. The system or pilot pressure is used to operate valves that control SSV 14 and SCSSV 16. Other pressure gauges include SSV pressure gauge 35 and SCSSV pressure gauge 37. Line pressure gauge 50 may be connected to various pressure sensors and used to display multiple pressures related to operation. Items 28 are additional panel control switches.

Two sockets 30 to pump two manual hydraulic pumps built into the weatherproof housing are provided. A handle may be inserted into either socket to operate one of the manual hydraulic pumps to separately provide pressure to open either the SSV 14 or the SCSSV 16. Other arrangements such as three pumps for pilot pressure, SSV pressure, and SCSSV pressure could be used or a single pump with selection switch or the like could be used. Due to remote operation, it is preferred to utilize manual hydraulic pumps rather than power operated pumps to allow the secure shutdown system to be used where power availability is limited or non-existent. However, the secure shutdown system could also be operated where power is available and powered pumps could be utilized.

FIG. 4 gives an overall schematic view of SSD 10. FIG. 4 schematically shows SSD 10 with logic control board 100 (shown in more detail in FIG. 3), various hydraulics, switches and connections to sensors and the like. SSD 10 is a self-contained battery operated unit that uses logic control board 100 to monitor the conditions of the wellbore 12 and rapidly communicate with solenoid valve 40 to close the SSV 14 and SCSSV 16.

Referring in more detail to FIG. 4, SSD 10 comprises three pressure circuits: (1) system/pilot pressure at 54, SSV actuator pressure 52, and SCSSV actuator pressure 56. The SSV 14 and SCSSV 16 will be closed when the pilot pressure is zero, which can be achieved either manually or electronically. Pilot pressure is utilized to operate valves 38 and 36 which control hydraulic pressure to SSV 14 and SCSSV 16, respectively. When pilot pressure drops to zero, the valves allow hydraulic pressure that otherwise hold SSV 14 and SCSSV 16 open to drop to zero. Because SSV 14 and SCSSV 16 are failsafe valves, they close as a result of loss of hydraulic pressure. Accordingly, SSD 10 preferably comprises two pilot operated valves, namely valve 38 for SSV 14 and valve 36 for SCSSV valve 16.

Electronic control unit 100 drives the two position solenoid valve 40 to the open position to bleed off the pilot pressure to thereby release actuator pressure on valves 36, 38 to close SSV 14 and SCSSV valve 16. Manual hydraulic pumps 30 are used to open the SSV 14 and SCSSV valve 16.

Accordingly, pressure release valves 36, 38 may be used to relieve control pressures and close the SSV 14 and SCSSV 16. The 2-position electronically controlled solenoid valve 40 can be moved to a close position to direct hydraulic pressure to bleed line 42 thereby closing SSV 14 and SCSSV 16. If the solenoid valve 40 is not able to reset after use then it is no longer possible to open SSV 14 and SCSSV 16 using hydraulic hand pumps 30. In this way, access to oil/gas reservoir by thieves can be prevented.

Solenoid 40 is controlled by logic control board 100. As discussed subsequently, the logic control board may disable operation of solenoid 40. However, if solenoid 40 is reset as per normal operation, e.g. once a fault problem is resolved such as emptying the tank, then the surface/subsurface valves can be opened by manually pumping hydraulic fluid with pumps 30. As indicated, manual hydraulic pumps 30 are shown that are used to open the surface/subsurface valves 14, 16 that are connected to SCSSV/SSV outputs 34, 35. Manual hydraulic pumps 30 each contain a hydraulic reservoir for operation.

If desired to manually and locally provide a security shutdown signal, one of the input pins, e.g. pin 1 as indicated at 103 may comprise a physical pin or component that is removable to disable resetting of solenoid valve 40 so that SSV 14 and SCSSV 16 can no longer be opened thereby preventing unauthorized access to wellbore 12. Replacement of the pin or component removes the security shutdown signal making panel operation of the valves possible again. Unit 100 might also be signaled remotely through telemetry interface 112 (telemetry system connector in FIG. 3) to close SSV 14 and SCSSV 16 and prevent operation of solenoid 40 thereby preventing reopening of these valves. Interface 112 would also allow a signal to negate the security shutdown signal making the panel operable to open the valves again.

Small accumulators 44, 46, and 48 are included in the pressure lines to compensate pressure so that pressure variance due to temperature and the like does not affect the operation of the SSV and SCSSV. A temperature loop hydraulic connector is provided at 41.

A Switching pressure gauge 50 is used for line pressure monitoring. The pressure may be switched and an isolator used for isolating the well bore fluid pressures utilizing sensor signals 51 that may be connected to pipeline 20, tank 22 and the like.

Figure 3:
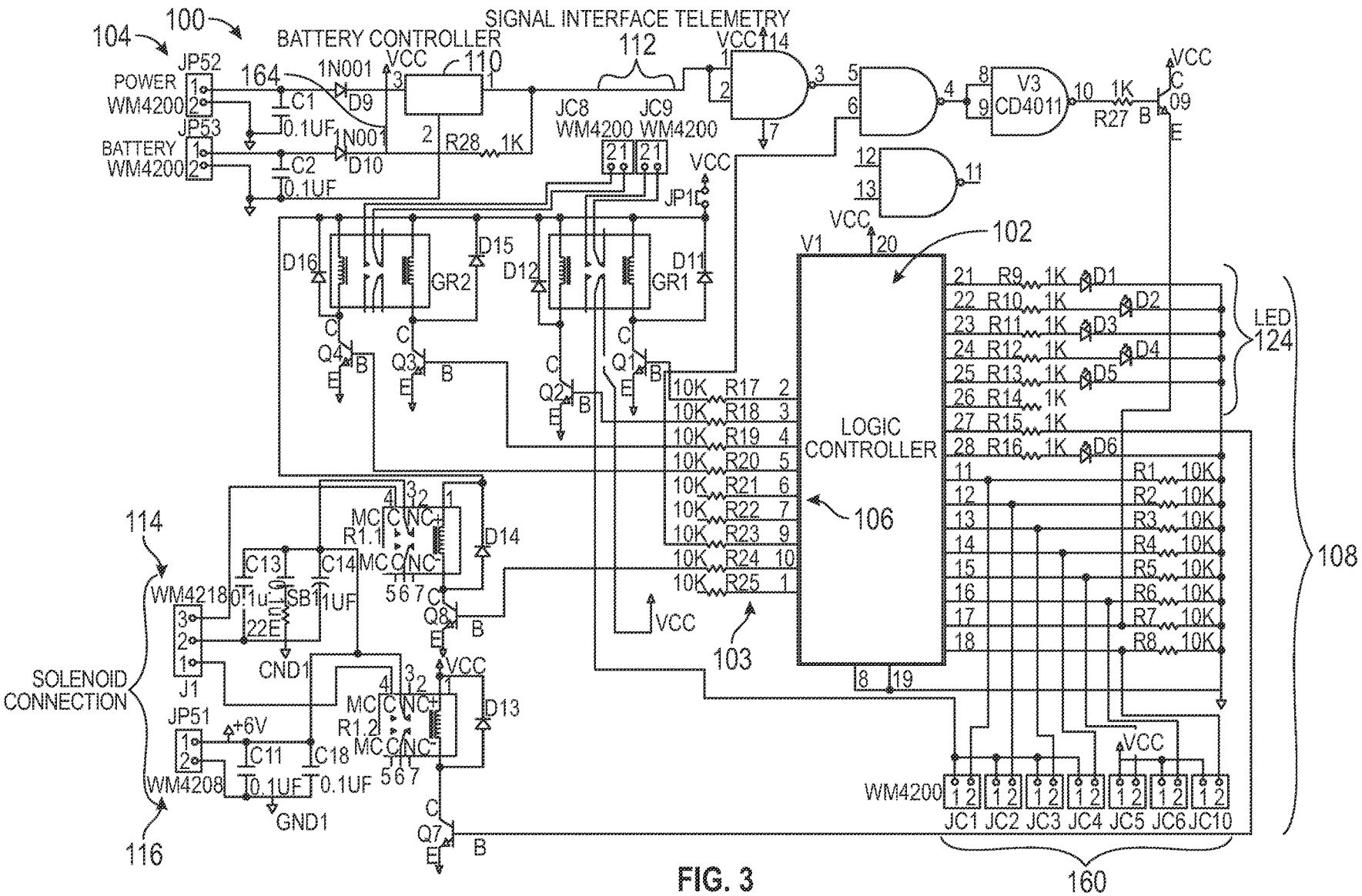
FIG. 3 is a circuit diagram for a logic control unit for an SSD in accord with one embodiment of the present invention.

Referring now to the logic control board 100 in FIG. 3, logic controller 102 is programmed in a manner to limit current usage of logic control board 100 to the micro-amp range—e.g. an average current less than ten microamperes. Preferably the normal or average draw of current without an input to programmable logic controller 102 that requires action is less than 10 microamperes but could be less. In this way, batteries 104 last from 3-5 years. Logic controller 102 may be a standard programmable logic chip. Several programming techniques are used to create the logic in logic controller 102 that result in such low current usage. On the input side at 106 where there are numerous inputs as discussed subsequently. Logic controller 102 is programmed so that virtually no current is used so long as there is not an input that requires action. So long as this is the case, the only activity within logic controller 102 may simply be for scanning the input pins at 106 to check for the presence of an input requiring processing or some action and to provide an LED status indication for the LED outputs 124 also indicated as status signals 24 on front panel 32 shown in FIG. 2. Another programming technique to limit current usage is that provide the outputs 108 from logic controller 102 are limited to short pulses and often simply a single short pulse in the millisecond range—e.g. a one millisecond pulse. In one embodiment the outputs are pulse and the programmable logic controller chip is programmed to limit outputs to pulses, often a single pulse unless used for a display LED, that is less than 10 milliseconds in duration.

Batteries 104 may comprise two batteries two sets of batteries with one being for operation of logic control board 100 and one for operation of solenoid 40. Battery voltage controller 110 monitors battery voltage and/or current and produces an output at 164 to shut down the wellhead or at least provide a notification that the battery power drops too low or requires changing the battery due to a voltage or current less than a predetermined voltage or current level.

As noted above, telemetry inputs 112 may be connected to a telemetry system to send/receive data and shut down the system remotely if desired.

Inputs to logic control board 100 and/or logic controller 102 may comprise: 1. High pressure signal from line pressure monitor gauge.

2. Low pressure signal from line pressure monitor gauge.
3. Remote shutdown signal from SCADU/RTU.
4. Emergency shutdown signal local (Electrical).
5. High Temperature shutdown signal.
6. SSD fault reset signal.
7. Previous fault display signal.

Accordingly, it will be appreciated that many conditions are monitored or could be monitored which if detected would result in a well shutdown signal to close the surface and subsurface valves 14, 16.

The Logic control unit 100 and/or logic controller 102 is designed to provide the following outputs, e.g. outputs 108 that perform the following ESD Shutdown (Solenoid 40 operation).

ESD Reset (Solenoid 40 operation).

System Normal Green Led (Blinking Control Lights 24)

System Fault Red Led High Pressure (Blinking Control Lights 24)

System Fault Red Led Low Pressure (Blinking Control Lights 24)

System Fault Red Led Telemetry Shutdown (Blinking Control Lights 24)

System Fault Red Led Aux Shutdown (Blinking Control Lights 24)

System Fault Red Led low Battery (Blinking Control Lights 24)

System fault Red Led Fire shutdown (all Led sequentially blinking Control Lights 24)

Low Battery operation—Remote Interface (Potential free Contact remote interface).

SSD Fault Shutdown—Remote interface (Potential free contract remote interface).

SSD remote shutdown interlock (Remote Interface interlock Scada/RTU). This is a security shutdown signal that prevents operation of the reset switch on the control panel. The security shutdown signal may come remotely or locally.

Output 116 is connected to solenoid 40 discussed earlier that is used to close the surface/subsurface valves 14, 16 and prevent access if the solenoid is not activated again in order to open the valves. Connection 114 is provided for connection to another solenoid if desired.

Operation of the SSD.

The SSD control panel 32 is a self-contained system designed and built to operate SSV 14 and SCSSV 16. The system is a self-sufficient and does not rely on external sources of energy or supply pressure to keep SSV and SCSSV open. Hydraulic circuits are provided for driving the SSV 14 and SCSSSV 16. Two separate pumps 30 and dump valves 36, 38 are provided to independently control SSV 14 and SCSSSV 16.

Panel 32 is assembled with a switching gauge 50 that monitors the pipeline 20 pressure (high and low pressures). The switching gauge 50 connects to the Logic control unit 100 and when Low pressure or High pressure is detected the logic control unit initiates the shutdown process and sets the corresponding alarm. The Shutdown can be initiated from different sources of inputs to the logic control unit. For example Aux Emergency Switch, RTU/Scada and Fire/Temperature switch as indicated at 60, 160. These are optional and customizable as per customer needs. There is a Hydraulic interface manual shutdown provided in the panel and optional fire loop (fusible plug) for emergency shout down, The Loop can be extended to operate as manual shutdown units.

The Panel may be provided with 3 gauges for internal monitor of the system/pilot pressure 33, SSV pressure 35 and SCSSV pressure 37 (see FIG. 2, 4). When an ESD (emergency shut down) is initiated the Hydraulic pressure is dumped into the inbuilt hydraulic reservoir 62 whereby SSV 14 and SCSSV 16 close.

A Green Led (System Normal) in LED group 24 shown in FIG. 2 is a blinking led that indicates that the SSD is working normally and the SSV and SCSSV is functioning normally (open). Whenever an alarm is initiated, the system normal green led turns off and the red led with the corresponding alarm turns on blinking. As discussed previously, the blinking function is programmed to the system to consume less power.

The SSD can reset from an alarm fault situation by pressing a Reset switch as indicated generally at 24 in FIG. 2. The system is programed to the give the operator a 30 min delay to physically reset the alarm before the alarm once again triggers the shutdown.

The SSD Test switch is programmed to indicate the previous fault indication along with the system normal indication just in case the fault was missed.

Other features and benefits will become apparent to those of skill in the art by reviewing the hydraulic features (FIG. 4) and electronics (FIG. 3) of the present invention.

The foregoing disclosure and description of the invention is illustrative and explanatory thereof, and it will be appreciated by those skilled in the art, that various changes in the size, shape and materials as well as in the details of the illustrated construction or combinations of features of the various elements may be made without departing from the spirit of the invention. Moreover, the scope of this patent is not limited to its literal terms but instead embraces all equivalents to the claims described.

The invention claimed is:

1. A secure shutdown system is connectable with a surface valve and a subsurface valve that are mounted to a wellbore, when the surface valve and the subsurface valve are open then a hydrocarbon fluid flow path is open through the wellbore to the surface, when either the surface valve or the subsurface valve are closed then hydrocarbon fluid flow is prevented from flowing from the wellbore, the secure shutdown system comprising:

a system housing;

a first manual hydraulic pump, the first manual hydraulic pump being hydraulically connectable to the subsurface valve to open the subsurface valve;

a hydraulic switch mounted to the system housing, the hydraulic switch being moveable between a first position and a second position, in the first position the hydraulic switch being configured to allow hydraulic fluid pressure from the first manual hydraulic pump to communicate with the subsurface valve to open the subsurface valve, in the second position the hydraulic switch being configured to prevent the first manual hydraulic pump from opening the subsurface valve;

a panel control switch mounted to the system housing; and a logic controller mounted in the system housing, the logic controller electrically connecting to the hydraulic switch and to the panel control switch, the logic controller being programmed to respond to the panel control switch to move the hydraulic switch to the first position, the logic controller being programmed to be responsive to a security shutdown signal to move the hydraulic switch to the second position whereupon the panel control switch is no longer operable to move the hydraulic switch to the first position.

2. The system of claim 1, further comprising the first manual hydraulic pump being mounted to the system housing.

3. The system of claim 2, further comprising a second manual hydraulic pump being hydraulically connectable to the surface valve to open the surface valve, the second manual hydraulic pump being mounted to the system housing, when the hydraulic switch is in the first position then the hydraulic switch is configured to allow hydraulic fluid pressure from the second manual hydraulic pump to communicate with the surface valve to open the surface valve, in the second position the hydraulic switch being configured to prevent hydraulic fluid pressure from the second manual hydraulic pump from opening the surface valve.

4. The system of claim 1 further comprising the logic controller comprising a programmable logic chip that is programmed so that an average current draw for the programmable logic chip is less than ten microamperes.

5. The system of claim 4 wherein the programmable logic chip is programmed to substantially limit operation to scanning inputs to check for a presence of an input requiring processing so long as an input requiring processing is not present.

6. The system of claim 5 wherein the programmable logic chip is programmed to limit outputs to a pulse less than ten milliseconds in duration.

7. The system of claim 1 further a control to monitor battery power, the control producing a well shutdown signal when battery power drops below a predetermined level.

8. The system of claim 1, wherein the security shutdown signal is received from a telemetry system connector.

9. The system of claim 1, wherein the security shutdown signal is produced by manually removing a component from the system housing.

10. The system of claim 1 further comprising a plurality of accumulators to compensate pressure in a plurality of pressure lines so that a pressure variance due to temperature is reduced.

* * * * *